US007854309B2

(12) United States Patent
Abe et al.

(10) Patent No.: US 7,854,309 B2
(45) Date of Patent: Dec. 21, 2010

(54) VALUE MEDIUM PROCESSING DEVICE FOR IC COINS AND MONETARY COINS

(75) Inventors: Hiroshi Abe, Iwatsuki (JP); Yoshinobu Tanaka, Iwatsuki (JP)

(73) Assignee: Asahi Seiko Kabushiki Kaisha, Tokyo (JP)

( * ) Notice: Subject to any disclaimer, the term of this patent is extended or adjusted under 35 U.S.C. 154(b) by 0 days.

(21) Appl. No.: 12/210,032

(22) Filed: Sep. 12, 2008

(65) Prior Publication Data

US 2009/0065326 A1 Mar. 12, 2009

(30) Foreign Application Priority Data

Sep. 12, 2007 (JP) ..... 2007-236501

(51) Int. Cl.
*G07F 1/00* (2006.01)
*G07F 1/04* (2006.01)

(52) U.S. Cl. ..... 194/344; 194/346

(58) Field of Classification Search ..... 194/216
See application file for complete search history.

(56) References Cited

U.S. PATENT DOCUMENTS 2,290,317 A * 7/1942 Deakin ..... 358/400
2,352,188 A * 6/1944 Farrell ..... 194/299
4,577,744 A * 3/1986 Doucet ..... 194/318
4,969,549 A * 11/1990 Eglise ..... 194/205
6,550,600 B2 * 4/2003 Faes et al. ..... 194/203

FOREIGN PATENT DOCUMENTS

JP 2005-293097 10/2005
JP 2006-189986 7/2006

* cited by examiner

*Primary Examiner*—Stefanos Karmis
*Assistant Examiner*—Mark J Beauchaine

(57) ABSTRACT

A valve medium processing device for IC coins and coins includes a housing having an insertion slot with an IC coin passage connected to receive IC coins from the insertion slot. A coin passage is also connected to receive coins from the insertion slot. A retaining unit for IC coins selectively stops and releases an IC coin, so that a read and/or write unit can establish a value for the IC coin. An IC coin allocating unit is positioned downstream in the IC coin passage for directing an IC coin to one of an IC coin storage passage and a retain passage. A coin allocating unit allocates a coin to one of a coin storage passage and the return passage.

19 Claims, 12 Drawing Sheets

VALUE MEDIUM PROCESSING DEVICE FOR IC COINS AND MONETARY COINS

BACKGROUND OF THE INVENTION

1. Field of the Invention

The present invention relates to a value medium processing device capable of distinguishing between a true and false status of a coin, including reading and/or writing specific electrical value information relative to a portable storage medium, and more specifically, a value medium processing device for inserting such a coin type electrical value information storage medium through a common monetary coin insertion slot, wherein the value medium processing device according to the present invention can be used in a coin-operated game machine, a vending machine, and the like.

2. Description of Related Art

Japanese Laid-Open Patent Publication No. 2006-189986 describes a denomination distinguishing mechanism in which an elongated path of the same width as an insertion slot is arranged behind a vertical slit shaped insertion slot capable of inserting either a IC coin or a monetary coin. A coin passage has an inclined surface of a relatively high gradient and a width for passing only coins is formed at a central part in the width direction at a bottom surface of the elongated path. A slit-shaped coin receiving slot of a width to which only the coins will pass through is arranged in front thereof, and an inclined surface of a low gradient is formed adjacent at both edges of the coin passage. The IC coin receiving part is formed in front of the slit shaped coin receiving slot.

Japanese Laid-Open Patent Publication No. 2005-293097 arranges a coin conveyance path to be inclined downward from an insertion slot, with a plurality of shutters in the coin conveyance path to distinguish the size of the inserted coin and for selectively opening the plurality of shutters, to allocate the IC coin and the coin to the appropriate corresponding processing units.

The Japanese Publication 2006-189986 has an advantage in that the monetary coin and the IC coin can be inserted into the same insertion slot, and the customer cannot mistake the insertion slot. However, the monetary coin is dropped to a coin passage by a shoulder of a downwardly inclined surface of a low gradient, and if the coin has developed sufficient inertia force by rolling, it may roll on the shoulder and not fall into the coin passage, and as a result, the desired coins cannot be selected.

The coin is identified after being allocated while rolling on the IC coin passage. Thus, a read and/or write device of the IC coin needs to be arranged downstream of the passage on which the coin rolls, and the device becomes correspondingly larger. The true and false status of a coin is also merely mechanically distinguished by thickness, and thus, a false coin of the same thickness cannot be distinguished.

In order to enhance the true and false distinguish accuracy, the diameter and the material need to be added to perform a more accurate true and false distinction, but such a distinguishing device would need to be arranged in continuation of the coin passage, and the device becomes even larger and thus cannot be formed of a size having compatibility with existing installed machines.

The Japanese Publication 2005-293097 would need to arrange an IC coin processing device and a coin true and false distinguishing unit at a downstream position with a shutter, and also cannot be formed to a small size having compatibility with the existing machines.

Therefore, there is still a need in this industry to provide a compact and economical combination coin and IC coin processing device that can be installed in new machines and retrofitted into existing machine configurations.

SUMMARY OF THE INVENTION

A first object of the present invention is to provide a value medium processing device for processing a small IC coin, a monetary coin and tokens of a compact configuration.

A second object of the present invention is to provide a value medium processing device for processing an IC coin and a monetary coin having compatibility with existing value medium processing device.

A third object of the present invention is to inexpensively provide a value medium processing device for processing small IC coins, monetary coins and tokens.

In order to achieve the above aims, a value medium processing device of the present invention has the following configuration.

The value medium processing device is a value medium processing device having a common insertion slot for a coin having a predetermined thickness, and also an IC coin thicker than the thickness of the coin. The value medium processing device includes an IC coin passage, formed as a continuation of the insertion slot, on which the IC coin rolls and a coin passage of a narrower width than the IC coin passage formed at a lower side of the IC coin passage as a continuation of the IC coin passage. A retaining unit for the IC coin is arranged in the IC coin passage, for selectively stopping and releasing the IC coin. A read and write unit is arranged in the vicinity of where the IC coin is stopped by the retaining member. An IC coin allocating unit, arranged at a position downstream of the retaining member in the IC coin passage can allocate the IC coin to an IC coin storage passage or a return passage. A distinguishing unit for a monetary coin is arranged on the second downward passage, and a coin allocating unit allocates a coin to a coin storage passage or a return passage based on a distinction signal from the distinguishing unit in the second downward passage. A common return slot is arranged as a continuation to the return passage.

A lower part of the IC coin passage and an upper part of the coin passage can be formed as a common passageway. The return passage can be arranged at a lower side of the coin passage for both the IC coin and the coin.

A deviating unit is capable of advancing and retreating into the IC coin passage at a downstream position of the common passage in the IC coin passage, and an IC coin detecting unit arranged in the IC coin passage between the insertion slot and the deviating unit wherein the deviating unit normally advances into the IC coin passage, and retreats from the IC coin passage when the IC coin detecting unit detects an IC coin. An insertion inhibiting unit capable of advancing to and retreating from the IC coin passage is arranged adjacent to the insertion slot, and advances to and retreats from the IC passage at a reverse phase with respect to the advancement and retreat of the above deviating unit to and from the IC coin passage.

The IC coin inserted from the common insertion slot is rolled onto the IC coin passage, rolls on the coin passage, and is stopped at a predetermined position by the rolling retaining unit. The IC coin stopped by the retaining unit has any predetermined stored information read and/or written thereto by the read and write unit arranged in the same vicinity. The IC coin, when a predetermined process thereon is terminated, is released from being stopped by the retaining member and is again rolled on the IC coin passage and allocated to the return passage or the storage passage by the IC coin allocating unit. An IC coin, allocated to the return passage, is rolled on the return passage to the return slot and returned to the customer, where as an IC coin allocated to the storage passage is stored in the storage unit.

A coin inserted through the common insertion slot can fall off the IC coin passage to the coin passage and rolls on the coin passage. In the middle of rolling, the coin's properties such as diameter, material, and thickness are detected by the distinguishing unit, and a true and false distinction and/or denomination are performed based on the detected information. The coin is allocated to the storage passage or the return passage by the coin allocating unit based on the distinguished result by the distinguishing unit.

A coin allocated to the return passage is rolled on the return passage to the common return slot and returned to the customer, where as the coin allocated to the storage passage is stored in the storage unit. Therefore, the IC coin passage and the coin passage are aligned in an up and down direction, respectively and arranged with the read and write unit and the distinguishing unit, sharing a common insertion slot and return slot for the IC coin and the coin, and thus the device can be miniaturized.

Furthermore, the lower part of the IC coin passage on which the IC coin rolls and the upper part of the coin passage on which the coin rolls are overlapping. Therefore, the device can be miniaturized by an overlapping amount of the passages of the IC coin and the coin.

The IC coin passage on which the IC coin rolls, the coin passage on which the coin C rolls, and the return passage for the IC coin and the coin are arranged so as to be shifted in the vertical direction, and thus the device can be further miniaturized. A true and false determination and the coin denomination are determined by the distinguishing unit in the middle of rolling along the coin passage.

When the IC coin is inserted through the common insertion slot, the IC coin is detected by the IC coin detecting unit during a course of the IC coin passage. According to the detection of the IC coin detecting unit, the deviating unit retreats from the IC coin passage, and thus the IC coin is rolled onto the IC coin passage without being inhibited by the deviating unit, and is stopped at a predetermined position by the retaining unit. In the retaining device, the stored information of the IC coin is read out and written by the read and write unit. Thus, the coin is reliably dropped onto the coin passage by the deviating unit, whereby miniaturization of the device can be achieved.

The insertion inhibiting unit advances to and retreats from the IC coin passage in a reverse phase with the deviating unit of the coin. In other words, if a IC coin exists in the IC coin passage, the insertion slot is substantially closed by the insertion inhibiting unit, and the IC coin and the coin cannot be inserted from the insertion slot.

Thus, an IC coin cannot be additionally inserted while reading or writing the IC coin, whereby a reading or writing error does not occur. Since the insertion inhibiting unit advances to and retreats from the IC coin passage at a reverse phase with the deviating unit of the coin, the drive source of the deviating unit and the insertion inhibiting unit may be common, whereby the device can be further inexpensively manufactured.

It is desirable for the present invention to be stored in the size of a conventional coin distinguishing machine from the standpoint of ensuring compatibility with the standard coin distinguishing device already used in game machines. The value medium processing device needs to be stored in a space having a width of 50 mm, a height of 130 mm, and a depth of 120 mm.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawings.

DETAILED DESCRIPTION OF THE PREFERRED EMBODIMENTS

Figure 1:
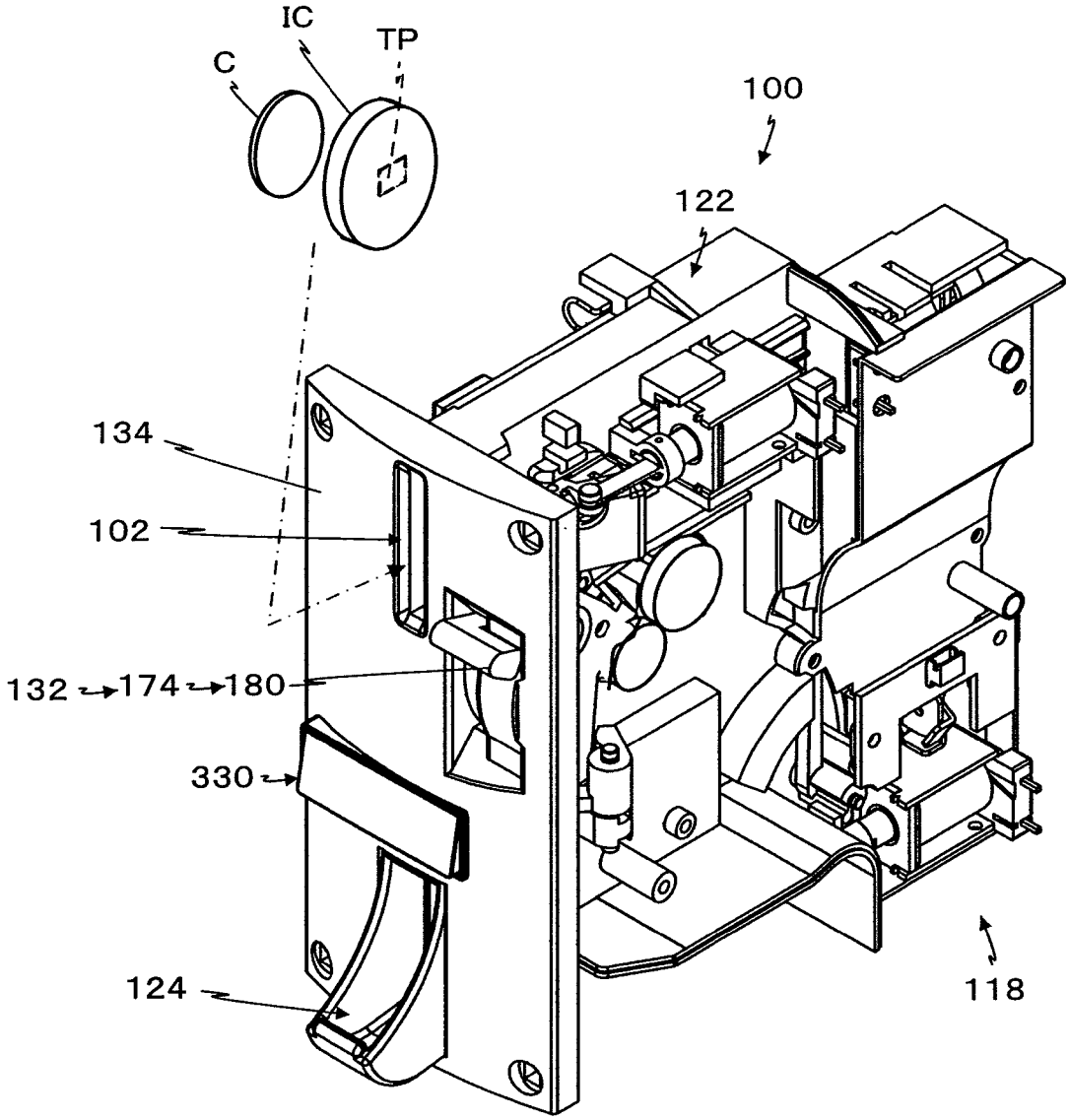
FIG. 1 is a perspective view of a value medium processing device.

Reference will now be made in detail to the preferred embodiments of the invention which set forth the best modes contemplated to carry out the invention, examples of which are illustrated in the accompanying drawings. While the invention will be described in conjunction with the preferred embodiments, it will be understood that they are not intended to limit the invention to these embodiments. On the contrary, the invention is intended to cover alternatives, modifications and equivalents, which may be included within the spirit and scope of the invention as defined by the appended claims. Furthermore, in the following detailed description of the present invention, numerous specific details are set forth in order to provide a thorough understanding of the present invention. However, it will be obvious to one of ordinary skill in the art that the present invention may be practiced without these specific details. In other instances, well known methods, procedures, components, and circuits have not been described in detail as not to unnecessarily obscure aspects of the present invention.

In the present specification, the term "coin" is a collective term for not only monetary coins but also coins serving as circulating medium, medals and tokens of a game machine, and the like, and "IC coin" is a collective term for a coin type electrical value storage medium.

In the present embodiment, coin C, such as but not limited to a monetary coin, has a circular disc shape made of metal, and can roll down a downward inclined passage by its own weight.

The IC coin is also of a circular disc shape that rolls down the downward inclined passage by its own weight, but further incorporates an IC chip TP with an antenna and an electronic storage capacity to hold a value capable of reading and writing in a non-contacting manner, and is thicker and with a larger diameter than the average coin C.

Also a coin electrical value information storage medium is an IC coin. The IC coin does not have necessarily a larger diameter than the coin C, but is preferably thicker with a larger diameter than the coin C so that the customer perceives it as having a higher value than a maximum price coin.

In the present embodiment, the IC coin is thicker than the coin C and the diameter is larger than, for example, a 500-yen coin. Therefore, the IC coin may have a smaller diameter than the coin C as long as it is thicker than the coin C.

The value medium processing device 100 includes an insertion slot 102, an IC coin passage 104, a coin passage 106, an IC coin retaining unit 108, a read and write unit 112, an IC coin allocating unit 114, a distinguishing unit 116, a coin allocating unit 118, a return passage 120, a return slot 124, a cancel unit 126, an IC coin detecting unit 128, and an insertion inhibit unit 132.

The insertion slot 102 will be first described. The insertion slot 102 has a function of receiving the coin C and the IC coin serving as the electrical value information storage medium. The insertion slot 102 also functions as the insertion slot for the coin C and the IC coin.

In the present embodiment, the insertion slot 102 is rectangular, and the width thereof is slightly larger than the thickness of the IC coin, and the height is slightly larger than the diameter of the 500-yen coin. Therefore, the IC coin, 5-yen to 500-yen coins, and game tokens can be inserted into the insertion slot 102.

The insertion slot installing range can be reduced since the insertion slot of the coin C and the IC coin is common, and there is an advantage in that the device can be miniaturized. In the present embodiment, the insertion slot 102 is formed in a front cover 134. The front cover 134 is fixed so as to cover the front face of the front panel 136 with a plate shape made of metal.

The IC coin passage 104 will be described with reference to FIGS. 6-8. The IC coin inserted into the insertion slot 102 rolls on the IC coin passage 104 by its own weight as a function of the inclination of the IC coin passage 104. The IC coin passage 104 is a downwardly inclined passage formed in continuation with the insertion slot 102, and is positioned to extend downward, the more the distant from the insertion slot 102, and further has an elongated slope shaped passage having a bottom and a left and right surrounded by the IC coin guide rail 162, the base 144, and the cancel cover 146.

Figure 6:
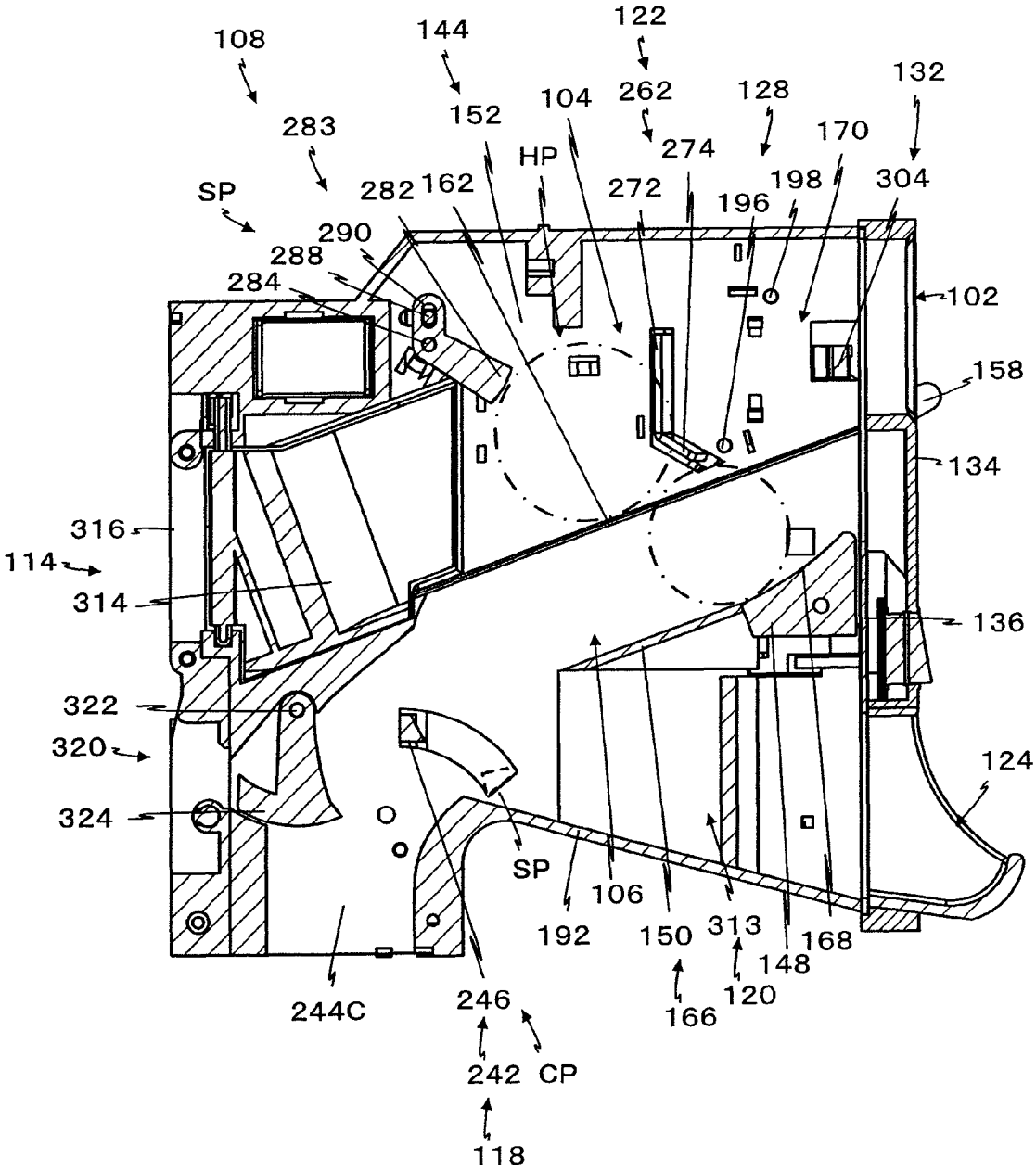
FIG. 6 is a cross sectional view taken along A-A in FIG. 5.

In other words, the IC coin passage 104 is a passage linearly extending to the lower left in FIG. 6 defined by the side surface 152 of the base 144, the side surface 160 of the cancel cover 146, and the IC guide rail 162. The IC coin guide rail 162 is a linear elongate projection formed to the lower front (lower left in FIG. 6) at a predetermined angle in continuation to the lower edge of the insertion slot 102, and includes a right guide rail 162R linearly formed integrally with the base 144, and the left guide rail 162L formed in a projecting manner symmetric to the right guide rail 162R integrally with the cancel cover 146. See FIG. 8.

The upper surfaces of the right guide rail 162R and the left guide rail 162L are formed downward to an inclined surface as they approach each other. The upper surfaces of the right guide rail 162R and the left guide rail 162L are formed symmetric to each other. The IC coin rolls so as to be guided to be positioned at the center of the IC coin passage 104 from the left and right guide rails.

The base 144 is a substantially rectangular plate body made of non-magnetic body vertically fixed perpendicular to the front panel 136. The side surface 152 of the base 144 is positioned in the same plane as the side surface 140 of the insertion slot 102 to guide the inserted coin C and the IC coin. The base 144 is preferably integrally molded by resin.

The cancel cover 146 is a substantially rectangular plate body made of a non-magnetic body, which has its upper end supported in a freely oscillating manner by a shaft 156 attached to the bearings 154A, 154B of the base 144. The cancel cover 146 is subjected to a rotation force so as to approach the base 144 by a bias spring 158, and the projection 159 at the lower end is pressed against the base 144 so that a predetermined spacing is set between the side surfaces 152 and 160. The cancel cover 146 is preferably integrally molded by resin. The left guide rail 162L is projected from the IC coin guide side surface 160 on the base 144 side of the cancel cover 146.

The coin passage 106 will now be described with reference to FIG. 6. The coin passage 106 has a function for guiding the coin C inserted through the insertion slot 102. The coin passage 106 continues to the IC coin passage 104, and linearly extends in parallel to the IC coin passage 104 at the lower side adjacent thereto.

The width of the coin passage 106 is thinner than the thickness of the IC coin, and has a width slightly wider than the thickness of a 500-yen coin, which is the thickest of all the 5-yen to 500-yen coins.

In other words, a coin C can fall to the coin passage 106, but the IC coin does not fall and continues to roll on the IC coin guide rail 162. The coin passage 106 is an elongated linear passage of a rectangular cross section surrounded by the coin guide rail 150, the base 144, and the cancel cover 146. In other words, the coin passage 106 inclines downward away from the insertion slot 102 and the upper end thereof communicates with the IC coin passage 104.

When a large diameter 500-yen coin rolls on the coin passage 106, the upper end thereof moves on the IC coin passage 104. In other words, the lower part of the IC coin passage 104 and the upper part of the coin passage 106 function as common passageway.

After inserted from the insertion slot 102, the coin C moves by substantially its diameter on the IC coin passage 104, and then falls onto the coin passage 106. The IC coin passage 104 continuing from the insertion slot 102 is a coin C common passage 170 with the IC coin passage 104. The coin guide rail 166 projects from the lower end of the side surface 160 of the cancel guide 146, and the upper face of the coin guide rail 166 inclines downward towards the base 144 side.

The coin C rolls while bearing on the base 144 by such an inclination, and thus there is an effect that the rolling position helps stabilize the coin C. The spacing between the side surface 152 of the base 144 and the coin guide side surface 164 is set slightly larger than the maximum thickness of the coin C to be selected.

The coin passage 106 is configured by the base 144, the cancel cover 146, and the coin guide rail 147. The coin guide rail 166 is configured by a rolling start guide rail 148 and a guide rail 150. The guide rail 150 is formed in parallel to the IC coin guide rail 162. The rolling start guide rail 148 is a trapezoid metal plate fixed to the cancel cover 146 adjacent to the front panel 136, and the falling rolling surface 168 continuing to the guide rail 150 is formed in a curved manner. The falling rolling surface 168 does not wear by the fall of the coin C, and the rolling speed of the coin C can be enhanced, see FIG. 6.

The IC coin passage 104 is a passage linearly extending towards the lower right in FIG. 6 and is defined by the side surface 152 of the base 144, the coin guide side surface 164 of the cancel cover 146 and the coin guide rail 147. The coin C can roll on the coin guide rail 166 in a standing or erect manner while having the side surface guided by the side surface 160 and the coin guide side surface 164.

The cancel unit 126 will now be described with reference to FIG. 4. The cancel unit 126 has a function of cancelling any coin C jammed in the IC coin passage 104 or the coin passage 106, or the inserted coin C, and returning the coin to the return slot 124. In the present embodiment, the cancel unit 126 includes a cancel cover 146, the cancel lever 174, and the first link mechanism 176.

The cancel lever 174 will be first described. The cancel lever 174 is a lever operated by the customer to cancel the coin C, and has a middle portion rotatably attached to the fixed shaft 178 projecting in the lateral direction from the base 144. An operation lever 180 is projected towards the front side of the front cover 134 from the opening 182 formed at the lower right side with respect to the insertion slot 102 of the front cover 134, and is arranged so as to be pushed by the customer.

Figure 4:
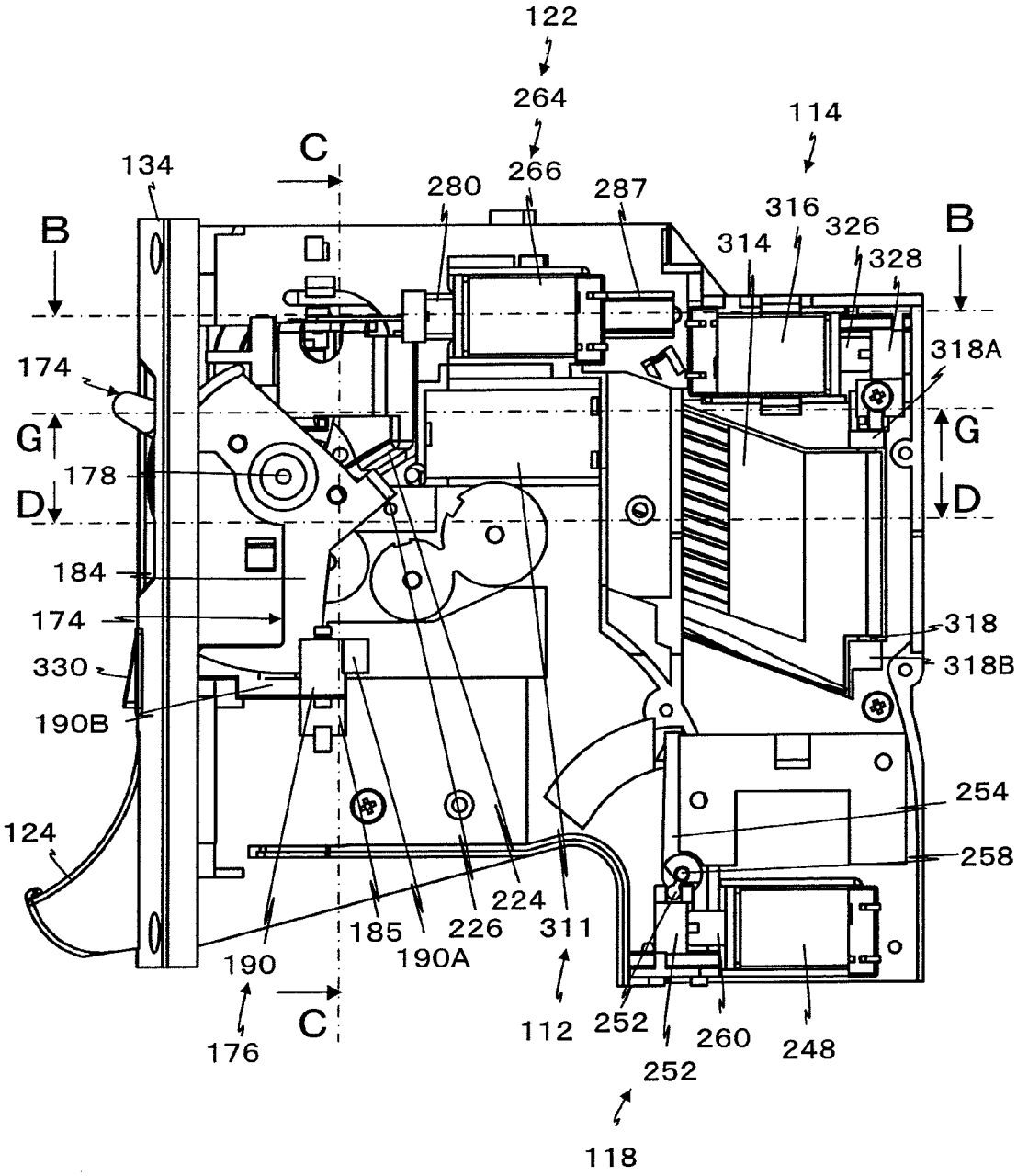
FIG. 4 is a right side view of the value medium processing device.

The lower lever 184 extends downward in parallel to the front panel 136, and is stopped and held by a stopper (not shown) at a standby position substantially in an upstanding position shown in FIG. 4.

First link mechanism 176 will now be described. The first link mechanism 176 has a function of moving the lower end of the cancel cover 146 in a direction of moving away from the base 144 when the lower lever 184 is turned in the counterclockwise direction in FIG. 4. The first link mechanism 176 includes an L-shaped first swinging lever 190 attached rotatably to the shaft 188 projecting upward from a stay 185 extending in the lateral direction from the base 144. The first lever 190A of the swinging lever 190 is pushed by the lower lever 184, and turned in the clockwise direction in FIG. 9.

The second lever 190B of the swinging lever 190 can come in contact with and be pushed to the lower end of the cancel cover 146 through the opening of the base 144. When the cancel cover 174 is rotated in the counterclockwise direction in FIG. 4, the lower lever 184 pushes the first lever 190A, and the second lever 190B pushes the lower end of the cancel cover 146 to be away from the base 144.

The cancel cover 146 rotates with the shaft 156 as the supporting point, is inclined with respect to the base 144, and a gap between the side end face of the coin guide rail 166 and the side surface 152 is greater than or equal to the thickness of the coin C. An upper surface of the guide rail 150 is inclined downward with respect to the lateral direction, and the coin C thereon falls by its own weight.

The dropped coin C falls on the coin returning guide rail 192 formed in the base 144 at the lower side of the coin passage 106, inclined downward towards the front panel 136 side, and configuring the return passage 120, and thereby after rolls to the right direction in FIG. 6 by its own weight and falls to the return slot 124. The return slot 124 is formed in a groove shape surrounding both sides and the front side of the coin C, and thus the coin C is held in a standing state in the return slot 124.

The detecting unit 128 of both the IC coin and the coin C will be described with reference to FIG. 6. The detecting unit 128 is arranged on the common passageway 170 and has a function of distinguishing whether the value medium inserted through the insertion slot 102 is the coin C or not. The detecting unit 128 can be changed to other devices having similar functions as known in the art.

In the present embodiment, the detecting unit 128 includes a first sensor 196 and a second sensor 198 arranged on the side surface 152 of the base 144. In the present embodiment, the first sensor 196 and the second sensor 198 are a transmissive photoelectric sensor positioned for detection by transversing the common passage 170, but may be changed to a reflection photoelectric sensor, a contacting sensor, and the like.

The first sensor 196 is arranged in the vicinity of the deviating unit 122 and the IC coin guide rail 162, where the projection light can be shielded by a passing coin C and the IC coin, and a detection signal is output at time of such shielding. The second smaller sensor 198 is arranged at a position not shielded by the coin C passing through the common passage 170 but is shielded by a large diameter IC coin.

Thus, when the projection light of the first sensor 196 and the second sensor 198 are simultaneously shielded, a distinction can be made that the IC coin has been inserted, and the deviating unit 122 is retrieved from the IC coin passage 104.

Figure 10:
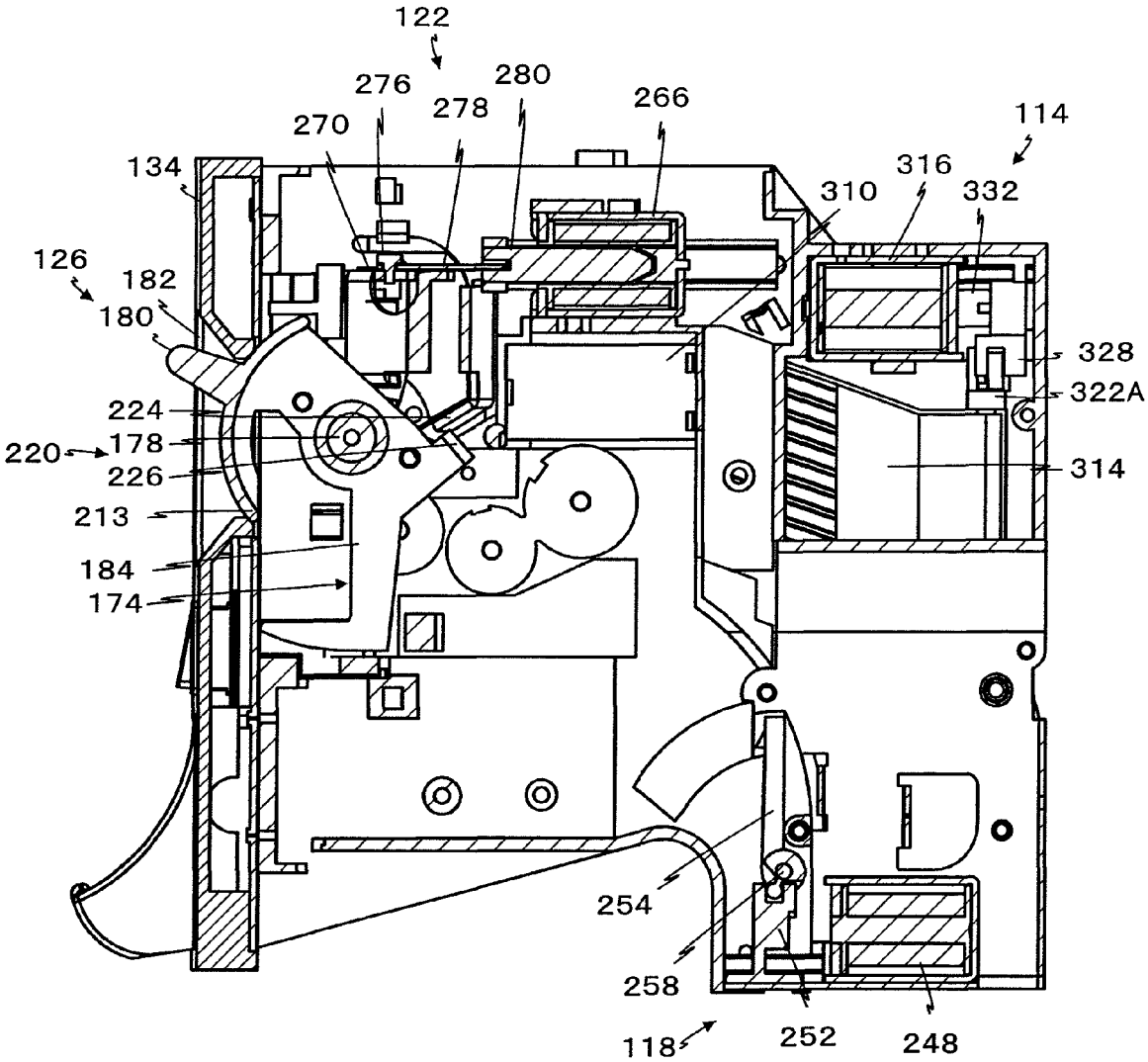
FIG. 10 is a cross sectional view taken along F-F in FIG. 5.

The cancel non-operating unit 220 will be described with reference to drawings such as FIG. 10. The cancel non-operating unit 220 has a function of causing a non-operating of the cancel unit 126, specifically, a function which places the cancel lever 174, when the IC coin is inserted into the insertion slot 102 into a non-operating mode. The cancel non-operating unit 220 can be changed to other known devices having a similar function.

In the present embodiment, the cancel non-operating unit 220 mechanically causes the cancel lever 174 not to operate. A structure in which the cancel unit 126 is mechanically non-operated has an advantage of being inexpensively configured.

The cancel non-operating unit 220 shares one part with the deviating unit 122 hereinafter described, and thus the description of the main part will be made in the description of the deviating unit 122. When the deviating unit 122 is at a non-deviating position, the integrally moving second stopper 224 projects into the rotating path of the engagement part 226, which is integrally formed with the cancel lever 174, and inhibits any rotation of the cancel lever 174.

Figure 3:
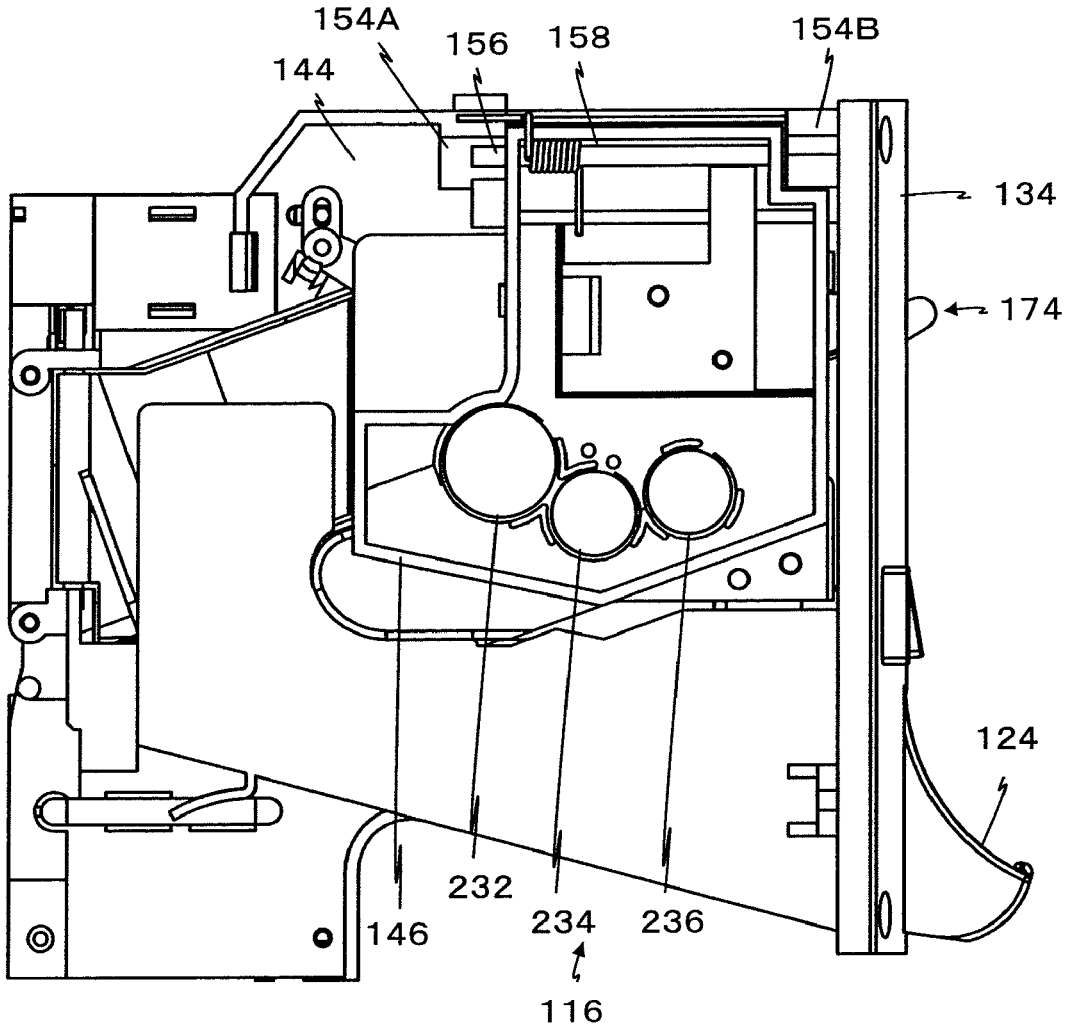
FIG. 3 is a left side view of the value medium processing device.

The distinguishing unit 116 has a function of distinguishing between a true and false condition and also the denomination of a coin rolling through the coin passage 106, that is the status of the coins. See FIGS. 3 and 6. The distinguishing unit 116 includes coil bodies 232, 234, 236 wound with a coil on a core relatively fixed to the base 144 and the cancel cover 146 along the coin passage 106. The coil body 232 is used to detect the diameter of the coin C. The coil body 234 is used to detect the thickness of the coin C. The coil body 236 is used to detect the material of the coin C.

The respective output from the coil bodies 232, 234, 236 are input into a distinguishing circuit (not shown) to distinguish the true and false condition and also the denomination of coin C in comparison to predetermined reference values that are stored. If a false coin is found, the distinguishing unit 116 outputs a cancel signal CS to the coin allocating unit 118.

The coin allocating unit 118 has a function of allocating a coin C rolling on the coin passage 106 to either the coin return passage 191 or the coin storing passage 244C to a retaining safe (not shown). The coin allocating unit 118 includes a coin allocating body 246, an electromagnetic actuator 248, and a second link mechanism 252.

The coin allocating body 246 can be positioned in a cancel position CP on the extension of the coin passage 106 or on the storing position SP to guide to the storage passage 244C. (See FIG. 6) The coin allocating body 246 is a rod body extending to the coin passage 106 towards a lateral direction from the distal end of the second swinging lever 254 which is attached rotatably to a fixed shaft 258 projecting in the lateral direction from the base 144.

The other end of the second swinging lever 254 is link coupled to the iron core 260 of the first electromagnetic actuator 248 by the link mechanism 252. The iron core 260 is biased in the left direction in FIG. 4 by a spring (not shown), and is normally held at a cancel position CP.

When the distinguishing unit 116 distinguish a true coin, the first electromagnetic actuator 248 is excited, the iron core 260 is moved to the right direction in FIG. 4, the second swinging lever 254 is turned in a counterclockwise direction, and the coin allocating body 246 is moved to and held at the storage position SP. When the coin allocating body 246 is held at the storage position SP, the coin C rolling on the coin passage 106 falls on the coin allocating body 246 from the coin guide rail 150, and is guided to the coin storage passage 244C.

If the coin allocating body 246 is positioned at the cancel position CP, the coin C dropped from the coin passage 106 comes into contact with the coin allocating body 246, and is guided to the right direction in FIG. 6, and thus rolls on the coin cancel guide rail 182 of the coin return passage 191, and is returned to the return port 124.

The deviating unit 122 will now be described with reference to FIGS. 6 and 7. The deviating unit 122 has a function of guiding the coin C inserted into the insertion slot 102 to the coin passage. The deviating unit 122 includes a deviating body 262, a third link mechanism 264, and a second electromagnetic actuator 266.

The deviating body 262 has a plate configuration and is formed in an L-shape, as shown in FIG. 6, and is positioned perpendicular to one end of the third swinging lever 270 which, in turn, is rotatably attached to a fixed shaft 268 that is fixed in parallel to the base 144.

The deviating body 262 has a perpendicular part 272 and a downward inclined part 274, where the inserted coin C will hit the perpendicular part 272 so that any rolling inertia force is eliminated, and after falling downward by its own weight, it is guided to the upper end opening of the coin passage 106 by an inclination of the guide rails 162L, 162R, to fall on the rolling surface 168 of the rolling start guide rail 148.

The end of the link 278 is rotatably attached to the shaft 276 projecting upward from the position distant from the base 144 than the fixed shaft 268 of the third swinging lever 270. The other end of the link 278 is rotatably attached to an iron core 280 of the second electromagnetic actuator 266. The iron core 280 is biased in the projecting direction by a spring (not shown).

Figure 7:
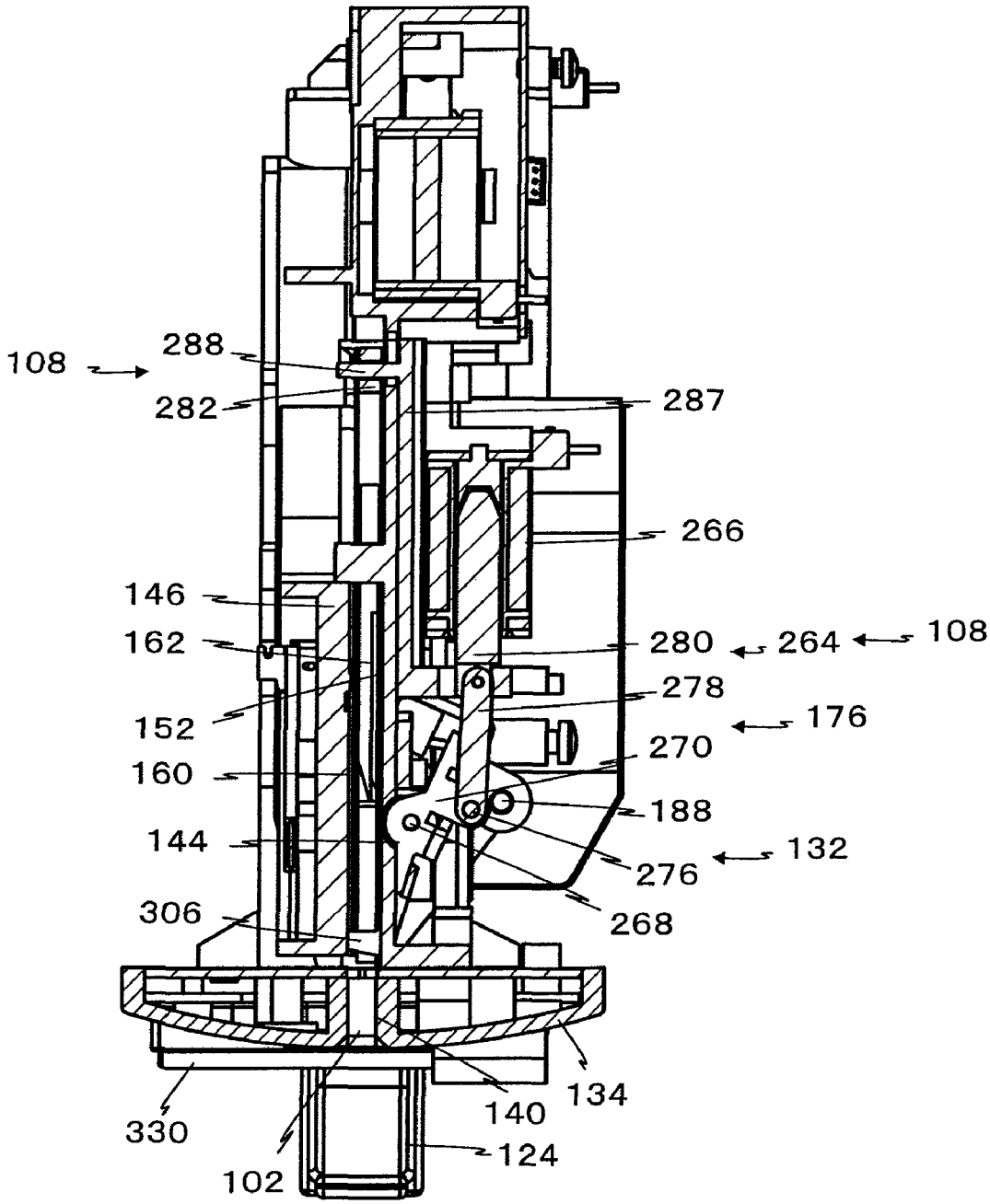
FIG. 7 is a cross sectional view taken along B-B in FIG. 4.
Figure 8:
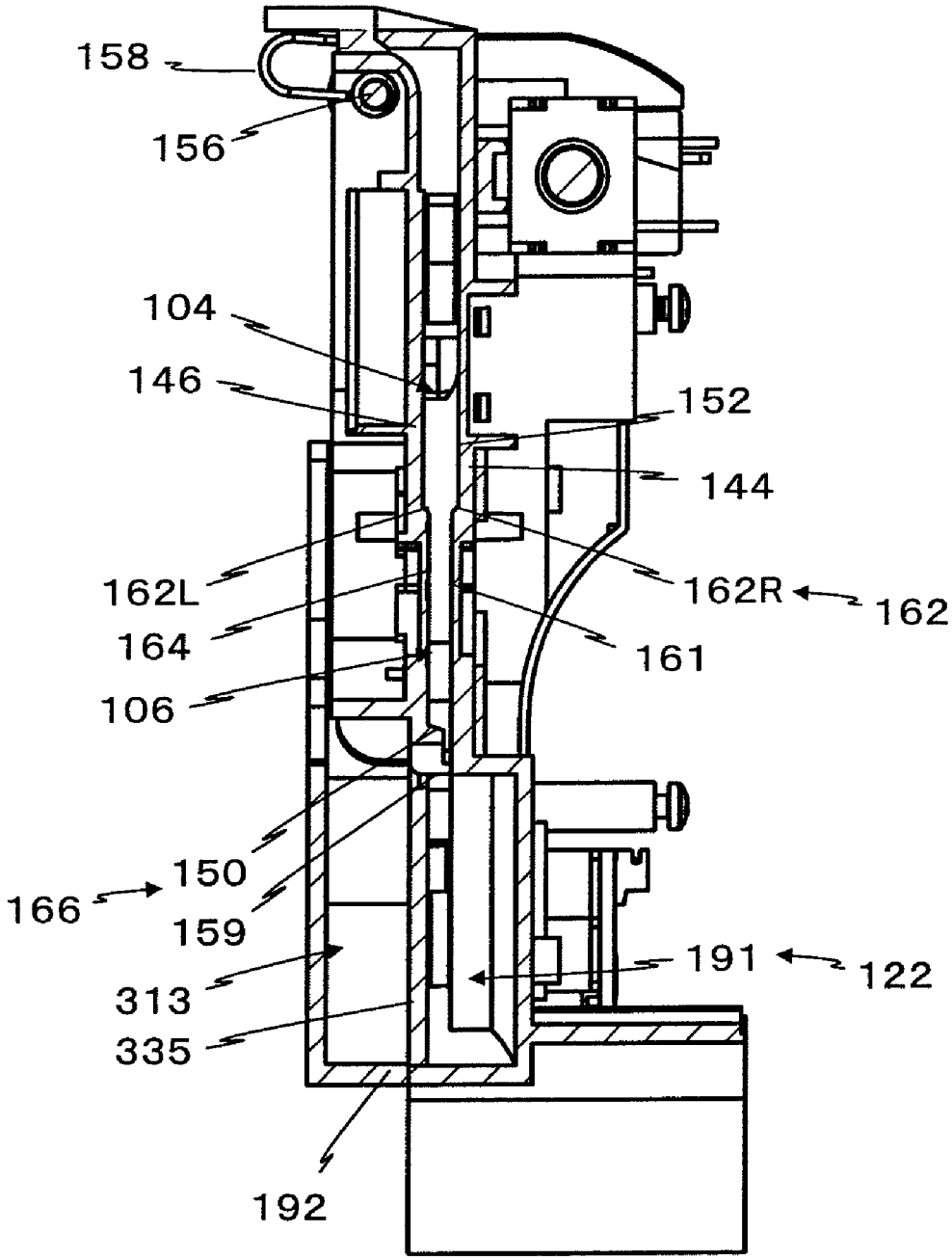
FIG. 8 is a cross sectional view taken along C-C in FIG. 4.

Thus, the second electromagnetic actuator 266 when excited causes the iron core 280 to be attracted, and when moved upward in FIG. 7, the third swinging lever 270 is rotated in a counterclockwise direction. The deviating body 262 is then advanced to the common passage 170 of the IC coin passage 104, and is positioned so as to substantially transverse the common passage 170. When the second electromagnetic actuator 266 is demagnetized, the iron core 280 is moved towards the left in FIG. 4 by a spring (not shown).

Figure 5:
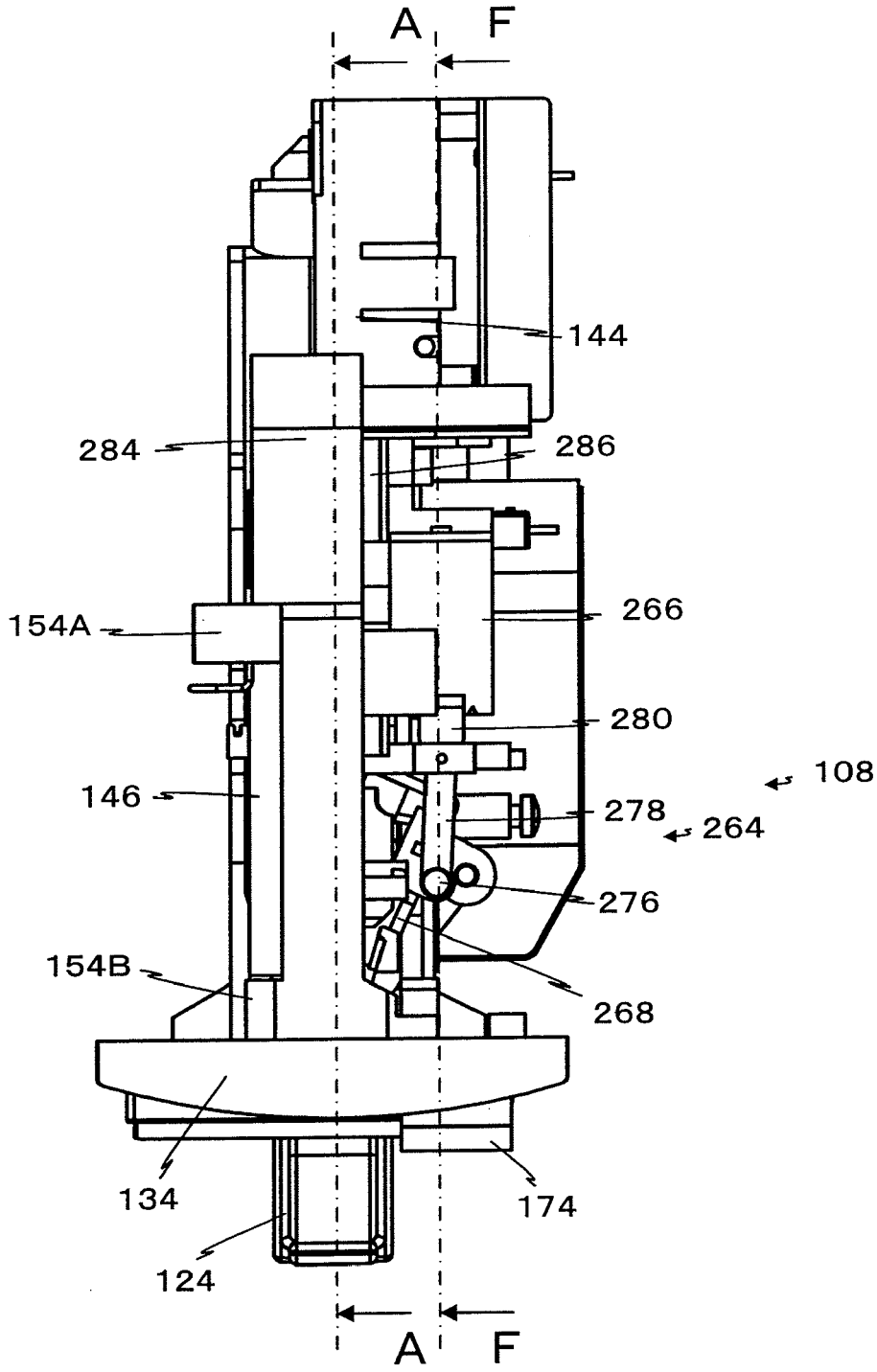
FIG. 5 is a plan view of the value medium processing device.

The third swinging lever 270 is rotated in the counterclockwise direction, and the deviating body 262 retreats from the common passage 170 (IC coin passage 104) (position of FIGS. 4, 5, 7). In this case, the insertion inhibiting member 306 advances to and retreats from the IC coin passage 104 adjacent to the insertion slot 102, and thus the coin C cannot be inserted.

A second stopper 224, serving as a cancel non-operating unit 220 is formed in a projecting manner on the rear surface side of the inclined part 274. When the deviating body 262 of the third swinging lever 270 retreats from the IC coin passage 104, the second stopper 224 advances to the rotation path of the engagement part 226 integrally formed at the swinging lever 180, and inhibits the rotation. When the deviating body 262 advances to the IC coin passage 104, the second stopper 224 retreats from the rotation path of the engagement part 226, and thus the swinging lever 180 is rotated for cancelling.

The IC coin retaining unit 108, FIG. 7, has a function of retaining the IC coin at the IC coin passage 104 when a IC coin is inserted. The IC coin retaining unit 108 includes a fourth link mechanism 283 of a stop strip 282 and the second electromagnetic actuator 266.

The stop strip 282 is rotatably attached to a fixed shaft 284 projecting to the side from the base 144 at the upper side of the IC passage 104, and is adjacent to the base 144, to be rotated within a plane parallel to the base 144. The fourth link mechanism 283 includes a slide strip 287 fixed to the iron core 280 and arranged for movement reciprocatably in the lateral direction while being guided by the base 144. A pin 288 projects in a lateral direction from the slide strip 287, and a long hole 290 is formed in the stop strip 282, where the pin 288 is slidably inserted into the long hole 290.

When the second electromagnetic actuator 266 is demagnetized, the slid strip 287 is positioned at the uppermost left side in FIG. 4, and thus the stop strip 282 is held at a holding position SP after being rotated in the clockwise direction in FIG. 6. When the stop strip 282 is positioned at the holding position SP, the IC coin rolling on the IC coin guide rail 162 comes into contact with the distal end of the stop strip 282 and is inhibited from rolling, and is held at the retaining position HP.

When the second electromagnetic actuator 266 is excited, the iron core 280 is moved towards the right direction in FIG. 4, and the stop strip 282 is rotated in the counterclockwise direction in FIG. 6. The distal end of the stop strip 282 is moved to a position not contacting the IC coin, and the IC coin can roll further to the left in FIG. 6 on the IC coin passage 104. The IC coin rolling on the IC coin passage 104 is guided to the storage passage 244IC or the coin return passage 313 by the IC coin allocating unit 114, see FIG. 9.

Figure 11:
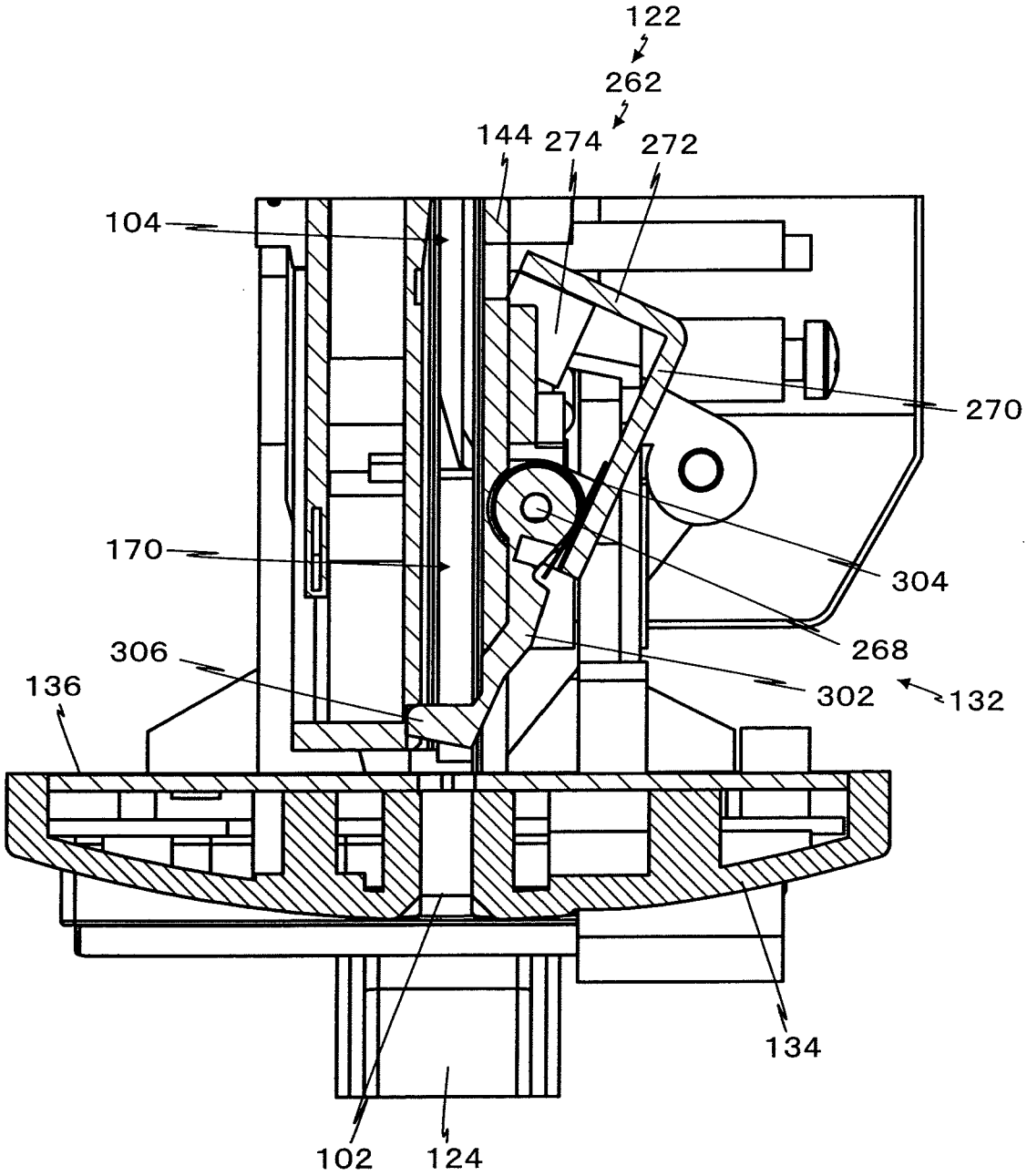
FIG. 11 is an enlarged explanatory view of an insertion inhibiting unit.

The insertion inhibiting unit 132 will now be described with reference to FIGS. 7 and 11. When the IC coin is retained at the retaining position HP, the insertion inhibiting unit 132 has a function of preventing the insertion of the coin C and the IC coin into the insertion slot 102. The insertion inhibiting unit 132 includes an L shaped lever 302 supported coaxially with a fixed shaft 268 which is the supporting shaft of the third swinging lever 270 and a spring 304 for elastically biasing the L shaped lever 302 in the clockwise direction in FIG. 11 with respect to the fixed shaft 268.

The distal end of the L shaped lever 302 is an inhibiting strip 306. The inhibiting strip 306 can advance to and retreat from the common passage 170 at a position proximate to the front panel 136 on the back side of the insertion slot 102. Thus, the deviating body 262 and the inhibiting strip 306 advance to and retreat from the common passage 170 at opposite phases by the oscillation of the third swinging lever 270.

More specifically, if the deviating body 262 is positioned at the common passage 170, the inhibiting strip 306 retreats from the common passage 170. If the deviating body 262 is retreated from the common passage 170, the inhibiting strip 306 is positioned at the common passage 170 facing the insertion slot 102. Thus, when the inhibiting strip 306 is positioned in the common passage 170, the coin C and the IC coin cannot be inserted into the insertion slot 102.

The read and write unit 112 has a function of reading and writing the IC chip TP of an IC coin retained at the retaining position HP and the value information via communication. In the present embodiment, the read and write unit 112 is fixed to the base 144, and is a communication substrate 311 mounted with the IC having a communication function and an antenna.

The IC coin allocating unit 114 has a function of allocating the IC coin released from being held by the stop strip 282 to the IC coin storage passage 244IC or the IC coin return passage 313. The IC coin allocating unit 114 includes an IC coin allocating body 314 and a third electromagnetic actuator 316. The IC coin allocating body 314 is rotatably supported by bearings 318A, 318B in which a vertical shaft 318 is formed in the base 144.

A driven lever 325 projecting to the side is fixed at the upper end of the vertical shaft 318, the free end of the driven lever 325 is inserted into a hole 332 of the driving body 328 fixed at the distal end of the iron core 326 of the third electrical actuator 316. If the third electrical actuator is demagnetized, the iron core 326 is held at the standby position shown in FIG. 12 projected by a spring (not shown).

Figure 9:
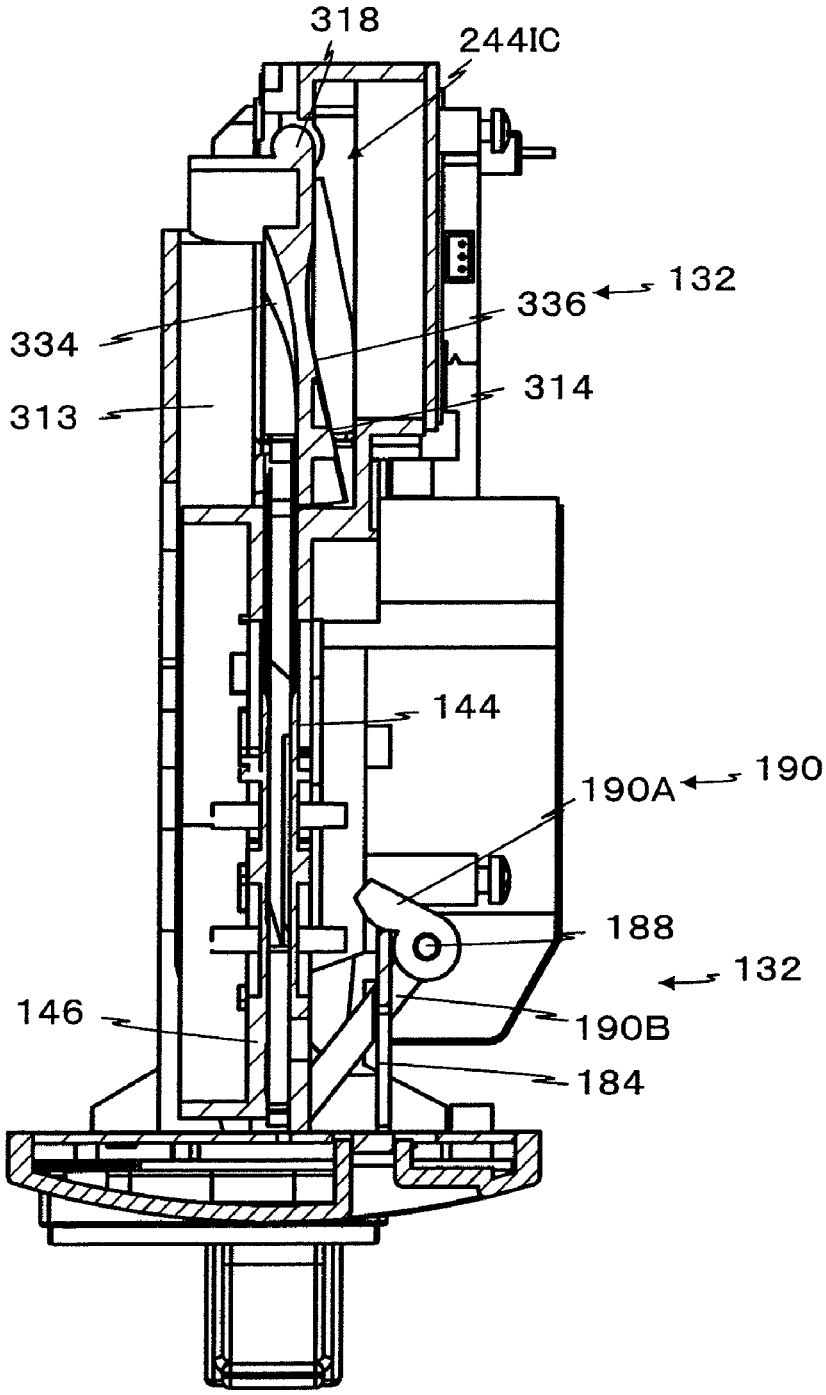
FIG. 9 is a cross sectional view taken along D-D in FIG. 4.

At the standby position, the IC coin allocating body 314 is held at the position of FIG. 9, and the return guide surface 334 which is one side surface is continued to the side surface 152 forming the IC coin passage 104, and thereafter gradually curved so as to project to the lateral direction in the downward direction. The IC coin is guided to the IC coin return passage 313 by such curve.

The IC coin return passage 313 is formed on the guide rail 150, partitioned by a partition wall 335, and arranged in parallel in the coin return passage 191. The partition wall 335 is positioned on the extension of the cancel cover 146.

When the third electric actuator 316 is excited, the IC coin allocating body 314 is rotated in the clockwise direction in FIG. 9, and the storage guide surface 336 on the back surface side of the return guide surface 334 is positioned on the extension of the side wall of the cancel cover 146. The storage guide surface 336 is formed in curved shape to guide the IC coin to the storage passage 244IC. The IC coin is guided to the IC coin storage passage 244IC.

The IC coin storage passage 244IC is partitioned with respect to the coin storage passage 244IC by the base 144, and is arranged in parallel.

An arm suspension preventing unit 320 is preferably arranged in the coin storage passage 244C. The arm suspension preventing unit 320 of the present embodiment is a fan shaped inhibiting body 324 attached in a swinging manner with respect to the shaft 322. Normally, one part of the inhibiting body 324 is suspended while projecting out of the storage passage 244 by gravity. When the true coin C passes, the inhibiting body 324 is moved by the coin C so that the coin C can pass. After the coin C has passed, the inhibiting body 324 restores by self-moment, see FIG. 6.

Thus, if the arm suspended coin C is pulled up, the inhibiting body 324 is subjected to force so that the inhibiting body 324 is pulled into the storage passage 244C by the coin C, and thus even when the coin C attempts to move through, the movement is inhibited by the inhibiting body 324 and cannot be pulled up.

Figure 2:
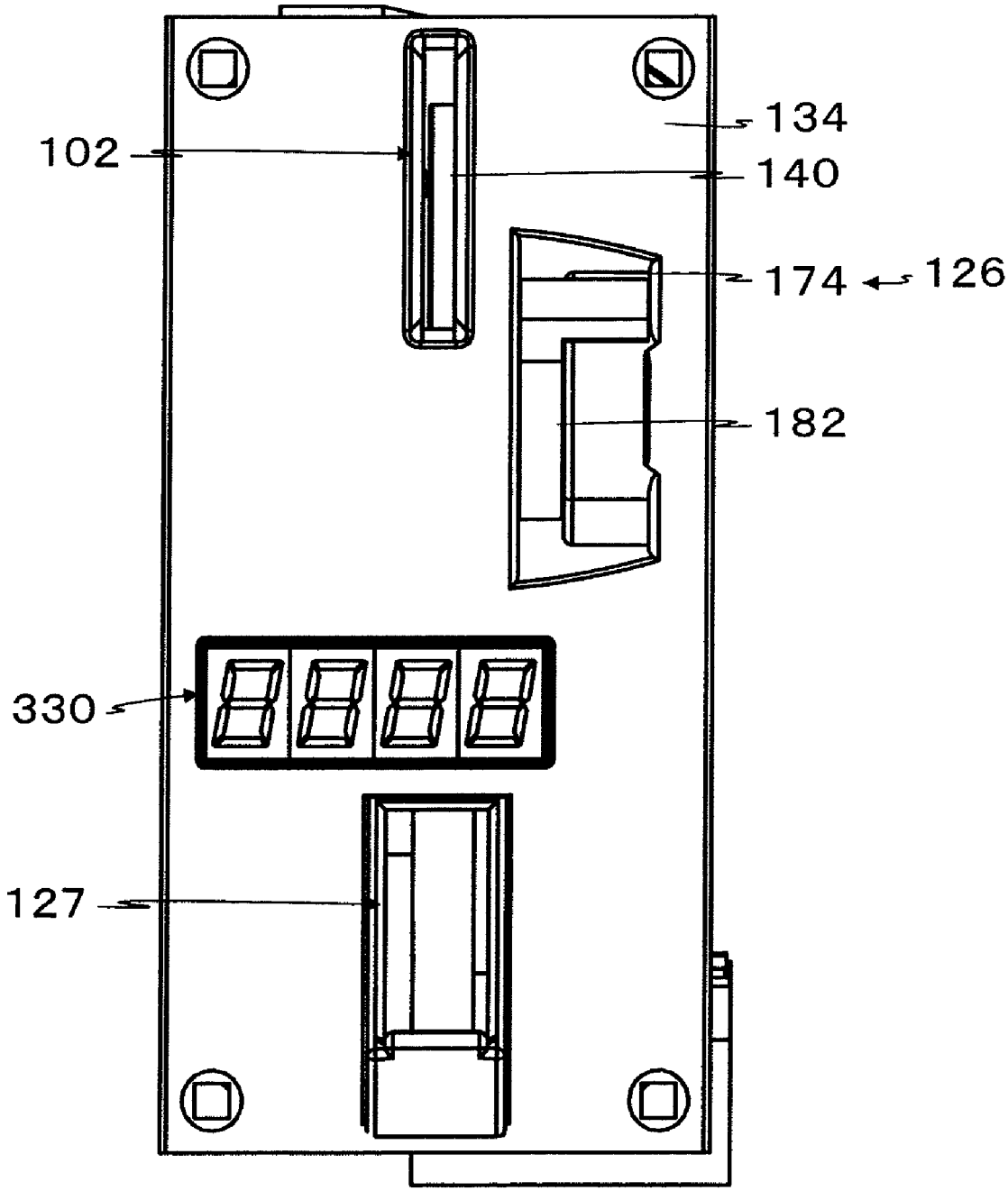
FIG. 2 is a front view of the value medium processing device.

An indicator 330 for displaying value information stored or to be stored in the IC chip TP of the IC coin or the IC card CD is preferably attached to the front cover 132. The indicator 330 is formed upward and is preferably arranged so as to be visible by the customer, see FIG. 2.

The front cover 134 may be manufactured with light transmissive resin, and a great number of LEDs may be arranged in the front panel 136 on the back surface side of the front cover 134 to emit light, thereby enhancing the decorative effect. Further, a speaker may be built in to play music or to make an announcement.

The operation of the present embodiment will now be described.

First, a case where a true coin C is inserted will be described. If the present value medium processing device 100 is not in a standby state, the second electromagnetic actuator 266 of the deviating unit 122 is demagnetized, the iron core 280 is moved downward by a spring (not shown), the third swinging lever 270 is rotated in the clockwise direction and is positioned at the most clockwise position (state of FIG. 7). The deviating body 262 is then held at a position retreated from the common passage 170.

On the other hand, the insertion inhibiting strip 306 is moved in a reverse phase advance to the common passage 170. Thus, the coin C and the IC coin cannot be inserted into the insertion slot 102 during a non-standby state.

If the present value medium processing device 100 is placed into a standby state, the second electromagnetic actuator 266 is excited, the iron core 280 is pulled up in FIG. 7, and the third swinging lever 270 is rotated in the counterclockwise direction via the link 278. Thus, the deviating body 262 advances to the common passage 170, and the insertion inhibiting strip 306 retreats from the common passage 170. The coin C or the IC coin then can be inserted to the insertion slot 102.

The first electromagnetic actuator 248 of the coin allocating unit 118 is demagnetized, and the iron core 260 is moved to the right direction in FIG. 4 by the spring (not shown), and thus the second swinging lever 254 is rotated in the most clockwise direction via the second link 252 (state of FIG. 4). The coin allocating body 246 is thereby held at the cancel position CP (solid line position in FIG. 6).

The third electromagnetic actuator 316 of the IC coin allocating unit 114 is also demagnetized, and held at a cancel position. In other words, the return guide surface 334 of the IC coin allocating body 314 is held at a position continuously continuing to the side wall 152 of the base 144 (state of FIG. 9).

A coin C inserted into the insertion slot 102 falls to the second downward passage 106 or rolls on the left guide rail 162L and/or the right guide rail 162R, moves in a direction diagonally lower left in FIG. 6 at the common passage 170 in the IC coin passage 104, and hits the perpendicular part 272 of the deviating body 262. Since the coin C has a small diameter, the optical axes of the first sensor 196 and the second sensor 198 are not simultaneously shielded, and thus the second electromagnetic actuator 266 remains excited.

The coin C hitting the perpendicular part 272 jumps back towards the insertion slot 102 side, annihilated with the movement inertia force to the lateral direction, and drops by gravity to be guided to the upper part of the coin passage 106 by the inclination of the left guide rail 162L and the right guide rail 162R, and thereafter is dropped on the rolling start guide rail 148.

The coin C, dropped on the rolling surface 168 of the rolling start guide rail 148, rolls while being accelerated by the arcuate surface and then rolls on the guide rail 150. When rolling, if the coin C is a large diameter coin such as 500-yen coin, the upper part of the 500-yen coin moves on the IC coin passage 104.

The coin C sequentially faces the sensor bodies 236, 234, 232 in the course of rolling on the guide rail 150, and identification information related to material, thickness, and diameter of the coin C are detected. The distinguishing unit 116 distinguish a true or false state and also the denomination value of the coin C from the identification information which can be displayed to the user.

When a coin is a distinguished as a true coin, the first electromagnetic actuator 248 is excited for a predetermined time. The iron core 260 is then pulled to the right direction in FIG. 4 by such excitation, and thus the second swinging lever 254 is rotated in the counterclockwise direction. The allocating body 246 is then moved to the retaining position SP shown in FIG. 6.

The coin C, dropped from the guide rail 150 drops onto the coin allocating body 246, at position 5P, jumps to the left side in FIG. 6, and is guided to the coin storage passage 244C. The coin C falling down the storage passage 244C is passed by rotating the inhibiting body 324 in the clockwise direction in FIG. 6, and retained in a retaining safe (not shown). Even if attempting to pull up the retained coin C by the arm suspension, the coin cannot be pulled up since it is inhibited by the inhibiting strip 324 as described above.

A case of when a false coin is inserted to the insertion slot 102 will be described. The false coin, inserted into the insertion slot 102 similarly rolls on the guide rail 150 of the coin passage 106. The distinguishing unit 116 outputs a false signal based on the identification information from the sensor bodies 236, 234, 232, and thus the first electromagnetic actuator 248 is not excited. The coin allocating body 246 is thus maintained at the cancel position CP in FIG. 6, and the false coin hits the allocating body 242, is guided to the coin return passage 191, and maintained in the return slot 124 and canceled.

A case where the IC coin is inserted to the insertion slot 102 will now be described. The IC coin rolls on the IC coin guide rail 162, and rolls on the IC coin passage 104 from the right to the left in FIG. 6. The IC coin blocks the projection light of the first sensor 196 and the second sensor 198 in the middle of rolling, and thus the detecting unit 128 detects the coin as an IC coin.

Figure 12:
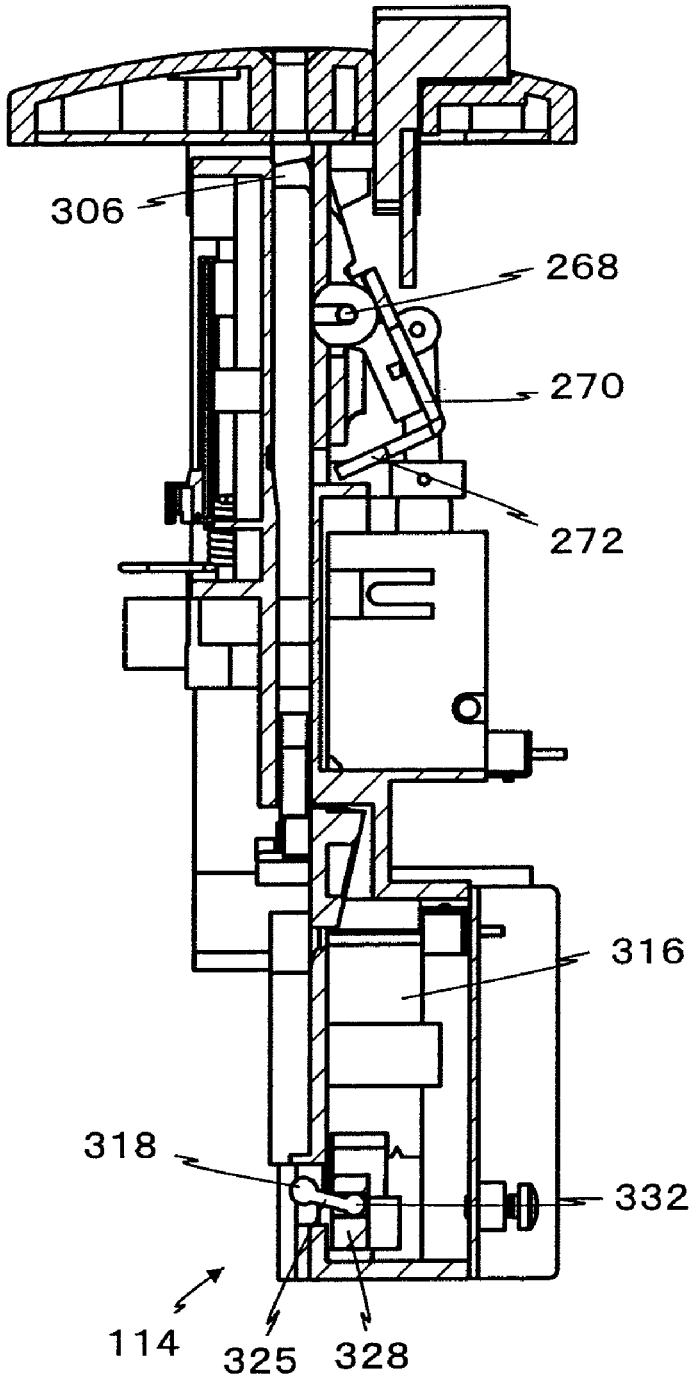
FIG. 12 is a cross sectional view taken along G-G in FIG. 4.

The second electromagnetic actuator 266 is then demagnetized, the iron core 280 is moved downward in FIG. 5, and thus the third swinging lever 270 is rotated in the clockwise direction, the deviating body 262 is retreated from the common passage 170, and the IC coin insertion inhibiting strip 306 is advanced to the common passage 170, so that a new coin C cannot be inserted (state shown in FIGS. 5, 12). Thus, the value of the previously inserted coin C can be displayed to the user to show potential added value to the IC coin.

An engagement strip 282 is rotated to the position of FIG. 6 via the slide strip 287 and the pin 288, and held at the IC coin holding position HP. The second stopper 224 is projected to the rotating path of the engagement part 226, and thus the cancel lever 174 will not rotate therewith. The IC coin rolls on the IC coin guide rail 162 and its upper end is stopped by the engagement strip 282 by the retreat of the deviating body 262 from the common passage 170, and thus the IC coin is retained at the retaining position HP (FIG. 6).

After being retained at the IC coin retaining position HP, communication is established with the IC chip TP embedded in the IC coin by the read and write unit 112, and value information is read or written. When the IC coin is retained at the IC coin retaining position HP, the cancel lever 174 cannot be rotated, and thus the IC coin is held between the base 144 and the cancel cover 146, so that the position is stabilized, whereby read and write error does not occur.

When the value information of the IC coin becomes zero, the third electromagnetic actuator 316 of the IC coin allocating device 132 is further activated by a control circuit (not shown) and response to a zero signal is excited, and the drive body 328 is moved upward in FIG. 12, and thus the distal end of the driven lever 325 is moved upward and the vertical shaft 318 is rotated in the counterclockwise direction. The IC coin allocating body 314 is rotated in the clockwise direction in FIG. 9 by such rotation, and the storage guide surface 336 is held at a storage positioning plane with the wall surface of the cancel cover 146.

The second electromagnetic actuator 266 is then excited and moved upward in FIG. 7. The slide strip 287 is then moved in the same direction, the engagement strip 282 is rotated in the counterclockwise direction in FIG. 6 via the pin 288, and moved to the non-holding position.

The IC coin whose engagement of the engagement strip 282 is released starts to roll by the inclination of the IC coin guide rail 162, and reaches the IC coin allocating body 314. Since the IC coin allocating body 314 is at the retaining position, the IC coin is guided to the storage guide surface 336 and guided to the IC coin storage passage 244IC.

If any value information remains in the IC coin, the third electromagnetic actuator 316 is not excited and is held at the cancel position. In other words, the return guide surface 334 of the IC coin allocating body 314 is held at a position in plane with the side surface 152 of the base 144. In this case, the IC coin is guided to the IC coin return passage 313 by the IC coin allocating body 314, and returned to the return slot 124.

As can be appreciated by a person of ordinary skill in this field, the present invention can be the operative apparatus for receiving an IC coin and deducting value and/or adding value to an IC coin. As such, monetary coins can be inputted and their value added to represent a desired total value to a user, which can be displayed in a conventional manner on the front of the machine, for example a display array 330 of LED's. The IC coin can then be submitted through the common entrance slot and value can be added and stored in the IC coin and the IC coin returned to the user. These functions can be controlled by a microprocessor circuit (not shown).

Those skilled in the art will appreciate that various adaptations and modifications of the just-described preferred embodiment can be configured without departing from the scope and spirit of the invention. Therefore, it is to be understood that, within the scope of the amended claims, the invention may be practiced other than as specifically described herein.

What is claimed is:

1. A value medium processing device for IC coins and coins comprising:

a housing having an insertion slot;

an IC coin passage operatively connected to receive IC coins from the insertion slot;

a coin passage operatively connected to receive coins from the insertion slot, wherein a lower part of the IC coin passage and an upper part of the coin passage form a common passage;

a retaining unit for IC coins arranged in the IC coin passage for selectively stopping and releasing an IC coin;

a read and/or write unit arranged in the IC coin passage for communicating with a memory in the IC coin to establish a value for the IC coin;

an IC coin allocating unit positioned downstream from the retaining unit in the IC coin passage for directing an IC coin to one of an IC coin storage passage and a return passage including a rotable allocating body with (1) a return guide surface which guides the IC coin to the return passage when a value is established in the IC coin, and (2) a storage guide surface, which is formed offset from the return guide surface and of a different surface configuration, to guide the IC coin to an IC coin storage passageway and means for rotating the rotable allocating body in response to a determination of a value status of the IC memory to operative position the guide surface or the storage guide surface depending on the value status;

a coin distinguishing unit to determine status of coins;

a coin allocating unit positioned downstream of the distinguishing unit for allocating a coin, based on the determination of the distinguishing unit, to one of a coin storage passage and the return passage;

a common return slot operatively connected to the return passage for releasing the coins and the IC coins;

an IC coin detecting unit for detecting an IC coin;

a deviating unit for advancing to and retreating from the IC coin passage at a position downstream of the common passage in the IC coin passage, wherein the IC coin detecting unit is arranged in the IC coin passage between the insertion slot and the deviating unit and the deviating unit advances into the IC coin passage, and retreats from the IC coin passage when the IC coin detecting unit detects an IC coin;

an insertion inhibiting unit that advances to and retreats from the IC coin passage is arranged adjacent to the insertion slot, and advances to and retreats from the IC passage at a reverse phase with respect to the advancement and retreat of the deviating unit to and from the IC coin passage, the insertion inhibiting unit is operatively connected with the retaining unit to block any insertion of a coin and/or an IC coin into the insertion slot when the retaining unit stops an IC coin; and an electromagnetic activator adjacent the IC coin passage for driving the deviating unit and the retaining unit, a user cancel lever extending from the housing to enable a user mechanically activated return of a coin to the common return slot; and cancel cover member forming a side of the coin passageway and operatively connected to the rotable allocating body and operatively connected to the user cancel lever and rotated against a bias spring to provide an opening large enough to permit a coin to fall by its own weight from the coin passageway to a return passage, wherein IC coins can be inserted and a current value of the IC coin can be determined and value can be subsequently added and or subtracted to the IC coin when coins are received and processed through the common passageway to add value during the retention of the IC coin, the IC coin is subsequently released to one of the coin storage passage and the return passage based on the status of the IC coin value.

2. The value medium processing device according to claim 1 wherein the insertion inhibiting unit includes an L-shaped lever that is spring biased.

3. The value medium processing device according to claim 1, wherein the return passage is arranged at a lower side of the coin passage.

4. The value medium processing device of claim 1 wherein the IC coin passage is wider than the coin passage.

5. The value medium processing device according to claim 1, wherein the return passage is arranged beneath the coin passage in a vertically stacked alignment with the IC coin passage and the coin passage.

6. The value medium processing device of claim 1 wherein the IC coin passage is wider than the coin passage and includes guide rails.

7. The value medium processing device of claim 1 further including a fan shaped coin inhibiting body forming a part of the coin storage passage and pivotally mounted for extending across a portion of the coin storage passage, the coin inhibiting body being movable and shaped on a side surface for contact with the coin to rotate out of the coin storage passage and permit storage of the coin wherein the shape of a lower surface of the coin inhibiting body prevents a return passage by the coin from storage.

8. A value medium processing device of claim 1 wherein the coin allocating unit includes a rod body extending into the coin passageway through an elongated slot at a location between the coin storage passage and the return passage and means for moving the rod body along the elongated slot whereby the rod body can prevent a coin from entering either the coin storage passage or the return passage.

9. A value medium processing device for IC coins and coins comprising:

a housing having an insertion slot;

an IC coin passage operatively connected to receive IC coins from the insertion slot;

a coin passage operatively connected to receive coins from the insertion slot, wherein a lower part of the IC coin passage and an upper part of the coin passage form a common passage, a retaining unit for IC coins arranged in the IC coin passage for selectively stopping and releasing an IC coin;

a read and/or write unit arranged in the IC coin passage for communicating with a memory in the IC coin to establish a value for the IC coin;

an IC coin allocating unit positioned downstream from the retaining unit in the IC coin passage for directing an IC coin to one of an IC coin storage passage and a return passage including a rotable allocating body with (1) a return guide surface which guides the IC coin to the return passage when a value is established in the IC coin, and (2) a storage guide surface, which is formed offset from the return guide surface and of a different surface configuration, to guide the IC coin to an IC coin storage passageway and means for rotating the rotable allocating body in response to a determination of a value status of the IC memory to operative position the guide surface or the storage guide surface depending on the value status;

a coin distinguishing unit to determine status of coins;

a coin allocating unit positioned downstream of the distinguishing unit for allocating a coin, based on the determination of the distinguishing unit, to one of a coin storage passage and the return passage;

a common return slot operatively connected to the return passage for releasing the coins and the IC coins;

an IC coin detecting unit for detecting an IC coin;

a deviating unit for advancing to and retreating from the IC coin passage at a position downstream of the common passage in the IC coin passage, wherein the IC coin detecting unit is arranged in the IC coin passage between the insertion slot and the deviating unit and the deviating unit advances into the IC coin passage, and retreats from the IC coin passage when the IC coin detecting unit detects an IC coin;

an insertion inhibiting unit that advances to and retreats from the IC coin passage is arranged adjacent to the insertion slot, and advances to and retreats from the IC passage at a reverse phase with respect to the advancement and retreat of the deviating unit to and from the IC coin passage, the insertion inhibiting unit is operatively connected with the retaining unit to block any insertion of a coin and/or an IC coin into the insertion slot when the retaining unit stops an IC coin; and an electromagnetic activator adjacent the IC coin passage for driving the deviating unit and the retaining unit, a user cancel lever extending from the housing to enable a user mechanically activated return of a coin to the common return slot; and a cancel cover member, pivotally mounted and forming a side of the coin passageway and operatively connected to a biasing spring member to position the cancel cover member on the side of the coin passageway and operatively connected to the user cancel lever which can rotate against the force of the bias spring member to provide a side opening of the coin passageway large enough to permit a coin to fall by its own weight from the coin passageway to a return passage, wherein IC coins can be inserted and a current value of the IC coin can be determined and value can be subsequently added and or subtracted to the IC coin when coins are received and processed through the common passageway to add value during the retention of the IC coin, the IC coin is subsequently released to one of the coin storage passage and the return passage based on the status of the IC coin value.

10. The value medium processing device of claim 9 wherein the cancel cover member is formed of plastic.

11. The value medium processing device of claim 9 further including a fan shaped coin inhibiting body forming a part of the coin storage passage and pivotally mounted for extending across a portion of the coin storage passage, the coin inhibiting body being movable and shaped on a side convex surface for contact with the coin to rotate out of the coin storage passage and permit storage of the coin wherein the shape of a lower convex surface of the coin inhibiting body prevents a return passage by the coin from storage.

12. The value median processing device of claim 9 further including means for cancelling the operation of the user cancel lever including a cancel non-operating unit that is mechanically operatively connected to the deviating unit to inhibit any rotation of the cancel lever.

13. The value machine processing device of claim 9 wherein the coin allocating unit includes a rod body extending into the coin passageway through an elongated slot at a location between the coin storage passage and the return passage and means for moving the rod body along the elongated slot whereby the rod body can prevent a coin from entering either the coin storage passage or the return passage.

14. The value machine processing device of claim 9 wherein the IC coin passage, the coin passage, IC coin storage passage, coin storage passage, the return passage, the insertion slot and common return slot are vertically aligned wherein a gravity fall of coins and IC coins are enabled in a compact housing width configuration.

15. A value medium processing device for IC coins and coins comprising:

a housing having an insertion slot;

an IC coin passage operatively connected to receive IC coins from the insertion slot;

a coin passage operatively connected to receive coins from the insertion slot, wherein a lower part of the IC coin passage and an upper part of the coin passage form a common passage;

a retaining unit for IC coins arranged in the IC coin passage for selectively stopping and releasing an IC coin;

a read and/or write unit arranged in the IC coin passage for communicating with a memory in the IC coin to establish a value for the IC coin;

an IC coin allocating unit positioned downstream from the retaining unit in the IC coin passage for directing an IC coin to one of an IC coin storage passage and a return passage;

a coin distinguishing unit to determine status of coins;

a coin allocating unit positioned downstream of the distinguishing unit for allocating a coin, based on the determination of the distinguishing unit, to one of a coin storage passage and the return passage including a rod body extending into the coin passageway through an elongated slot at a location between the coin storage passage and the return passage and means for moving the rod body along the elongated slot whereby the rod body can prevent a coin from entering either the coin storage passage or the return passage;

a common return slot operatively connected to the return passage for releasing the coins and the IC coins;

an IC coin detecting unit for detecting an IC coin;

a deviating unit for advancing to and retreating from the IC coin passage at a position downstream of the common passage in the IC coin passage, wherein the IC coin detecting unit is arranged in the IC coin passage between the insertion slot and the deviating unit and the deviating unit advances into the IC coin passage, and retreats from the IC coin passage when the IC coin detecting unit detects an IC coin;

an insertion inhibiting unit that advances to and retreats from the IC coin passage is arranged adjacent to the insertion slot, and advances to and retreats from the IC passage at a reverse phase with respect to the advancement and retreat of the deviating unit to and from the IC coin passage, the insertion inhibiting unit is operatively connected with the retaining unit to block any insertion of a coin and/or an IC coin into the insertion slot when the retaining unit stops an IC coin; and an electromagnetic activator adjacent the IC coin passage for driving the deviating unit and the retaining unit, a user cancel lever extending from the housing to enable a user mechanically activated return of a coin to the common return slot;

cancel cover member forming a side of the coin passageway and operatively connected to the rotable allocating body and operatively connected to the user cancel lever and rotated against a bias spring to provide an opening large enough to permit a coin to fall by its own weight from the coin passageway to a return passage, wherein IC coins can be inserted and a current value of the IC coin can be determined and value can be subsequently added and or subtracted to the IC coin when coins are received and processed through the common passageway to add value during the retention of the IC coin, the IC coin is subsequently released to one of the coin storage passage and the return passage based on the status of the IC coin value; and a coin inhibiting body forming a part of the coin storage passage and pivotally mounted for extending across a portion of the coin storage passage, the coin inhibiting body being movable and shaped on a side upper surface for contact with the coin to rotate out of the coin storage passage and permit storage of the coin wherein the shape of a lower surface of the coin inhibiting body prevents a return passage by the coin from storage.

16. The value medium processing device of claim 15 wherein the IC coin allocating unit includes a rotable allocating body with (1) a return guide surface which guides the IC coin to the return passage when a value is established in the IC coin, and (2) a storage guide surface, which is formed offset from the return guide surface and of a different surface configuration, to guide the IC coin to an IC coin storage passageway and means for rotating the rotable allocating body in response to a determination of a value status of the IC memory to operative position the guide surface or the storage guide surface depending on the value status.

17. The value medium processing device of claim 15 further including means for cancelling the operation of the user cancel lever including a cancel non-operating unit that is mechanically operatively connected to the deviating unit to inhibit any rotation of the cancel lever.

18. The value medium processing device of claim 16 wherein the coin inhibiting body is pivotally mounted for extending across a portion of the coin storage passage and sloped with a convex surface on the side upper surface and a concave surface on the lower surface.

19. The value medium processing device of claim 18 wherein the IC coin passage, the coin passage, IC coin storage passage, coin storage passage, the return passage, the insertion slot and common return slot are vertically aligned wherein a gravity fall of coins and IC coins are enabled in a compact housing width configuration.

* * * * *